US007175574B2

(12) United States Patent
Carmel et al.

(10) Patent No.: US 7,175,574 B2
(45) Date of Patent: Feb. 13, 2007

(54) EXERCISE DEVICE

(75) Inventors: Sunny Carmel, Birmingham, AL (US); Dalit Drori, Hod Hasharon (IL)

(73) Assignee: Spri Products, Inc., Libertyville, IL (US)

( * ) Notice: Subject to any disclaimer, the term of this patent is extended or adjusted under 35 U.S.C. 154(b) by 20 days.

(21) Appl. No.: 10/774,719

(22) Filed: Feb. 9, 2004

(65) Prior Publication Data

US 2004/0180767 A1 Sep. 16, 2004

Related U.S. Application Data

(60) Provisional application No. 60/445,967, filed on Feb. 7, 2003.

(51) Int. Cl.
*A63B 21/02* (2006.01)

(52) U.S. Cl. ..... 482/124; 482/126

(58) Field of Classification Search ..... 482/79–80, 482/121–126, 129–130, 904, 74
See application file for complete search history.

(56) References Cited

U.S. PATENT DOCUMENTS 2,035,010 A * 3/1936 Arthur ..... 601/23
4,441,707 A * 4/1984 Bosch ..... 482/131
4,930,767 A * 6/1990 Hamm ..... 482/80
4,961,573 A * 10/1990 Wehrell ..... 482/74
5,234,395 A * 8/1993 Miller et al. ..... 482/118
5,336,151 A * 8/1994 Van Ballegooie ..... 482/124
5,916,070 A * 6/1999 Donohue ..... 482/74
6,425,844 B1 * 7/2002 Azar ..... 482/79
6,450,929 B1 * 9/2002 Markham ..... 482/121
6,648,804 B2 * 11/2003 Chen ..... 482/125
6,659,921 B2 * 12/2003 Vernon ..... 482/124

OTHER PUBLICATIONS

XERCUFFS®PLUS—Light Resistance, sold by SPRI®Website advertising and selling product at the following web address: http://www.spriproducts.com/detail.cfm?category_id=3 &subcatergory_id=1888product_id=264.
Product Label of XERCUFFS®sold by SPRI®.

* cited by examiner

*Primary Examiner*—Jerome Donnelly
*Assistant Examiner*—Fenn C. Mathew
(74) *Attorney, Agent, or Firm*—Barnes & Thornburg LLP; Thomas J. Donovan

(57) ABSTRACT

An exercise device including a resistance tube and a body engaging member for engaging a portion of a user's body, such as, for example, a foot, a leg, a hand or arm. The exercise device can be used in connection with various types of exercise, including, for example, Pilates, yoga, core conditioning, stability and stretching.

16 Claims, 3 Drawing Sheets

EXERCISE DEVICE

This application claims priority to provisional application No. 60/445,967 filed Feb. 7, 2003.

BACKGROUND AND SUMMARY

The present disclosure relates to an exercise device.

Resistance exercise devices are known. An example of a known resistance exercise product is disclosed, for example, in U.S. Pat. No. 5,800,322.

The present disclosure relates to an exercise device including a resistance tube and a body engaging member for engaging a portion of a user's body, such as, for example, a foot, a leg, a hand or arm. The exercise device can be used in connection with various types of exercise, including, for example, Pilates, yoga, core conditioning, stability and stretching. A wide variety of forms of exercises can be performed with the exercise device.

Additional features of the present disclosure will become apparent to those skilled in the art upon consideration of the following detailed description of illustrative embodiments of the disclosure.

BRIEF DESCRIPTION OF THE DRAWINGS

The detailed description particularly refers to the accompanying figures in which.

DETAILED DESCRIPTION OF THE ILLUSTRATED EMBODIMENT

Figure 1:
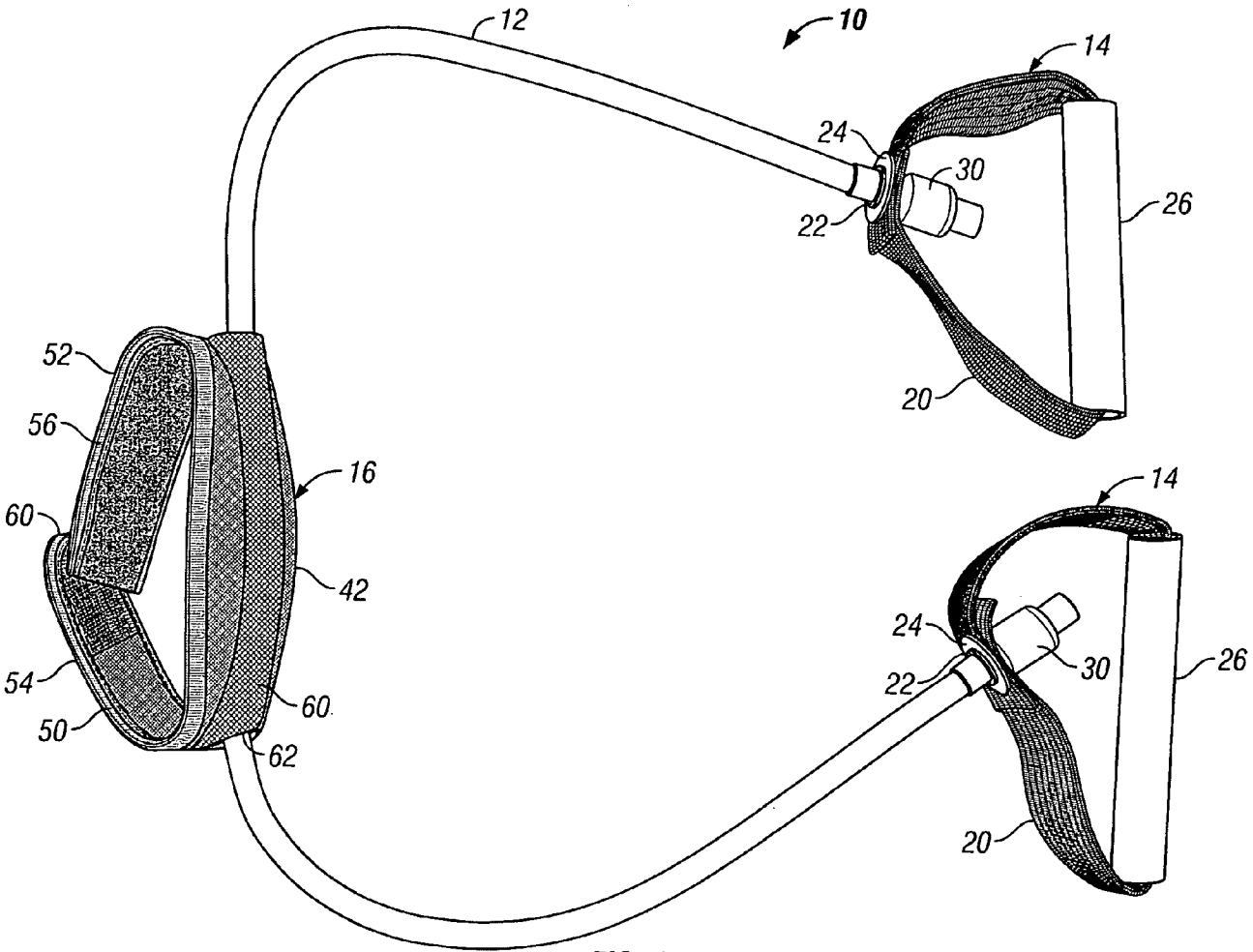
FIG. 1 is a perspective view of an exercise device in accordance with an embodiment of the present disclosure.

While the present disclosure may be susceptible to embodiment in different forms, there is shown in the drawing, and herein will be described in detail, an embodiment with the understanding that the present description is to be considered an exemplification of the principles of the disclosure and is not intended to limit the disclosure to the details of construction and the arrangements of components set forth in the following description or illustrated in the drawing.

FIGS. 1–4 illustrate an exercise device 10 in accordance with an embodiment of the present disclosure. The illustrated exercise device 10 comprises an elongated resistance tube 12, a pair of handles 14, and a body engaging member 16 secured to the resistance tube along the length thereof. The resistance tube 12 may have any suitable construction, configuration and dimensions. The resistance tube 12 may, for example, be any commercially available rubber resistance tube. The illustrated resistance tube 12 is constructed of rubber and may have any suitable dimensions.

The handles 14 also may have any suitable construction, configuration and dimensions and may be secured to the resistance tube 12 in any suitable manner and at any suitable location. U.S. Pat. No. 5,800,322, which is incorporated herein by reference, provides examples of handles 14 and of methods of securing the handles to the resistance tube. In the illustrated embodiment, for example, each handle 14 is associated with a respective end of the resistance tube 12. Each handle 14 comprises a fabric strip 20 forming a loop and defining a hole 22 receiving the resistance tube 12, a metal grommet 24 disposed about the hole, and a tubular hand grip 26 constructed of PVC or the like disposed about the strip. A sleeve 30 may be disposed about each end of the resistance tube 12. A rubber plug 32 or the like may be disposed within the resistance tube 12 adjacent each of its two ends. Each plug 32 is received snugly within a channel defined by the resistance tube 12 adjacent the respective open end of the resistance tube and is configured to expand the channel and portions of the resistance tube and sleeve 30 disposed about the plug. As a result, each plug prevents the respective handle 14 from disengaging from the resistance tube 12 by preventing the respective handle from moving distally of the plug. The handles 14 may instead comprise any other type of strip 20 or other structure secured to the resistance tube 12 in any suitable manner. The strip 20 or other structure may be constructed of any suitable material and have any suitable configuration in accordance with other embodiments. Similarly, each of the grommet 24, the hand grip 26, the sleeve 30, and the plug 32 may have any other suitable construction or configuration or may be omitted in accordance with other embodiments.

The body engaging member 16 may also have any suitable construction or configuration, and may be secured to the resistance tube 12 in any suitable manner and at any suitable location. In the illustrated embodiment, for example, the body engaging member 16 is in the form of a contoured nylon engaging strip 42 that includes a pair of connecting portions 50 and 52 releasably securable to form a loop to receive a portion of the user's body. The illustrated connecting portions 50 and 52 include hook and loop fasteners associated with opposed ends for securing the strip into the loop. The hook and loop fasteners may comprise fastening strips 44, 46 affixed to the strip 42 along its length. One of the hook and loop fastening strips 44 is secured to one side 54 of the connecting portion 50. The other hook and loop fastening strip 46 is secured to one side 56 of the connecting portion 52. The lead end 60 of the overlapping portion 50 is rounded to facilitate ready grasping of the overlapping portion to disengage it from the connecting portion 52. The strip 42 may have any other suitable construction in accordance with other embodiments. The connecting portions 50 and 52 may instead be releasably securable in any other suitable manner, such as, for example, with clips, hooks, buttons, ties, etc. in accordance with other embodiments.

The strip 42 may be secured to the resistance tube 12 in any suitable manner. In the illustrated embodiment, for example, the body engaging member 16 includes a mounting strip 60 that defines a channel 62 for receiving and slidably engaging the resistance tube 12. The mounting strip 60 may be a nylon strip positioned to define the channel 62 and stitched, welded or otherwise secured to the engaging strip 42 in any suitable manner. The mounting strip 60 may have any other suitable construction and configuration or may be omitted, and the channel 62 may be in any suitable form and have any suitable dimensions in accordance with other embodiments.

Figure 2:
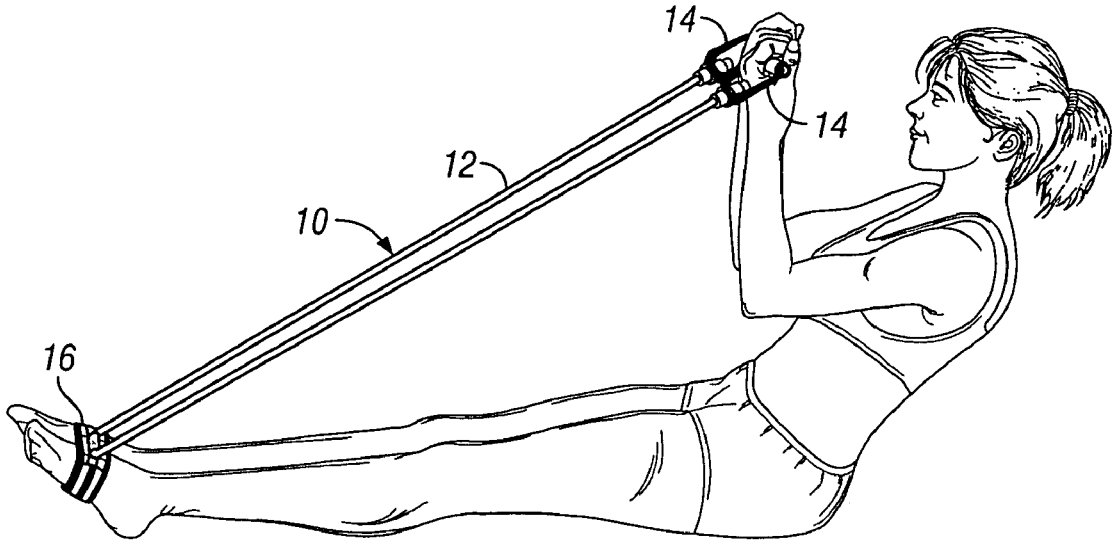
FIG. 2 is a perspective view of the exercise device of FIG. 1 and a user of the device stretching the exercise device.
Figure 4:
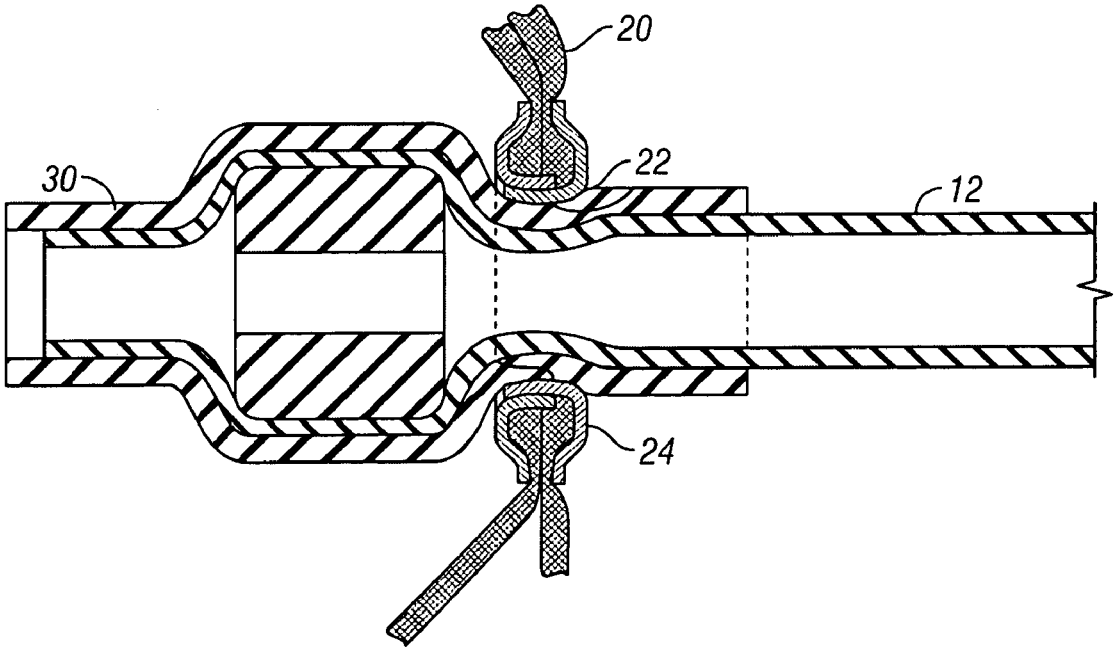
FIG. 4 is a broken view in section illustrating the plug, sleeve and grommet for securing one of the handles to the elongated tube of the exercise device of FIG. 1.
Figure 3:
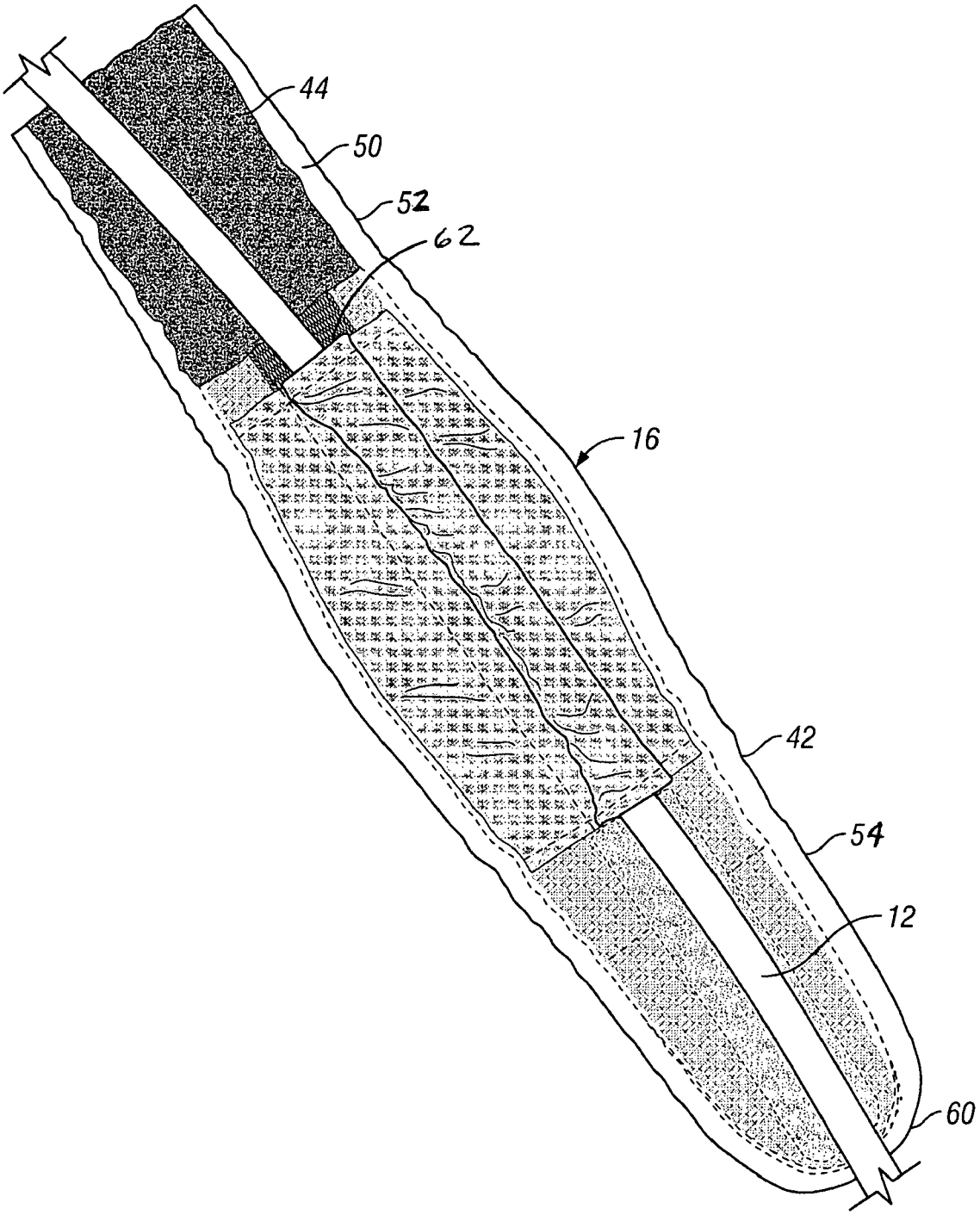
FIG. 3 is a partial perspective and enlarged view of the body engaging member of FIG. 1.

The exercise device 10 can be used in connection with various types of exercise, including, for example, Pilates, yoga, core conditioning, stability and stretching. The exercise device 10 can be used in any suitable manner. FIG. 2, for example, illustrates the user stretching the exercise device 10, with the body engaging member 16 secured around both feet of the user and the handles 14 being held by the user to stretch the resistance tube 12. The body engaging member 16 can be engaged with a single foot or any other part of the feet or legs or with a hand or any other part of the arms in accordance with other exercises. Further, either of the handles 14 can instead be engaged with any other part of the legs or any other part of the arms in accordance with other embodiments. There are countless exercises that can be performed with the exercise device 10.

While the concepts of the present disclosure have been illustrated and described in detail in the drawings and foregoing description, such an illustration and description is to be considered as exemplary and not restrictive in character, it being understood that only the illustrative embodiment has been shown and described and that all changes and modifications that come within the spirit of the disclosure are desired to be protected by the following claims:

The claimed invention is:

1. An exercise device comprising:

(a) an elongated resistance tube stretchable along its entire length;

(b) at least one handle secured to the elongated tube to enable the tube to be stretched along substantially its entire length by exerting a force on the handle; and (c) an engaging member having a first side and an opposite side, the engaging member having a width and a length between a first end and a second end with the length being greater than the width and with the engaging member being flexible along substantially its entire length, (d) the first side including an adjustable means for releasably adjusting to different sizes to engage different portions of a user's body whereby the first end and second end are releasably fastenable in different positions to permit engaging different portions of a user's body, and (e) the opposite side including a channel slidably engaging the elongated tube along the length of the elongated tube for adjustably locating the engaging member on the elongated tube and wherein the channel is slidable along substantially the entire length of the tube, the channel extending along a portion of the length of the engaging member with the adjustable means extending from the channel to at least one end of the engaging member.

2. The exercise device of claim 1 wherein the elongated tube includes a pair of ends and further comprising an other handle secured to the elongated tube, each handle associated with a respective one of the ends of the elongated tube.

3. The exercise device of claim 1 wherein the engaging member comprises nylon.

4. The exercise device of claim 1 wherein the first end and second end are connecting portions rounded to facilitate grasping for unsecuring the connecting portions.

5. The exercise device of claim 1 wherein the connecting portions comprise hook and loop fastening means.

6. The exercise device of claim 1 wherein a strip is stitched to the engaging member and defines the channel.

7. The exercise device of claim 1 wherein the channel comprises a flexible material.

8. The exercise device of claim 1 wherein the channel is pivotable about the length of the tube.

9. The exercise device of claim 8 wherein the channel is pivotable 360° about the length of the tube when the exercise device is not in use.

10. The exercise device of claim 1 wherein the channel is pivotable about the length of the tube when the exercise device is in use.

11. An exercise device comprising;

(a) an elongated resistance tube having a length and being stretchable along substantially its entire length;

(b) first and second handles secured to the elongated tube at spaced locations along the length of the tube; and (c) an engaging member having a first side and an opposite side, the engaging member having a width and a length between a first end and a second end with the length being greater than the width and with the engaging member being flexible along the tube length, (d) the first side including an adjustable means for releasably adjusting to different sizes to engage different portions of a user's body, and (e) the opposite side including a channel slidably engaging the elongated tube for adjustably locating the channel on the elongated tube such that the channel, engaging member and tube are connected to permit channel to move along substantially the entire length of the elongated tube from the first handle to the second handle.

12. The exercise device of claim 11, the engaging member including connecting portions releasably securable to each other to form a loop configured to receive a portion of the user's body.

13. The exercise device of claim 12 wherein the connecting portions comprise hook and loop fastening means.

14. The exercise device of claim 11 wherein the body engaging member comprises nylon.

15. An exercise device comprising:

(a) a hollow elongated resistance tube having a length and being stretchable along substantially its entire length;

(b) at least one handle secured to the tube to enable the handle to pull the tube and stretch the tube; and (c) an engaging member having a first side and an opposite side, the engaging member having a width and a length between a first end and a second end with the length being greater than the width and with the engaging member being flexible along substantially its entire length, (d) the first side including an adjustable portion whereby the first end and second end are releasably fastenable in different positions to permit engaging different portions of a user's body, (e) the opposite side including a channel slidably coupling the tube along the length of the tube for adjustably locating the engaging member on the tube such that the channel, engaging member and tube are constructed to permit the channel to move along substantially the entire length of the elongated tube, and wherein the elongated member is rotatable about the length of the tube passing through the channel.

16. The exercise device of claim 15 wherein the tube comprises rubber.

* * * * *